United States Patent [19]

Simonette et al.

[11] Patent Number: 4,695,176

[45] Date of Patent: Sep. 22, 1987

[54] FOUNTAIN APPLICATION HANDLE WITH REFILL VALVE

[75] Inventors: Dallas W. Simonette, Stacy; Bruce A. Wiener, Shoreview, both of Minn.

[73] Assignee: Power-Flo Products Corporation, Minneapolis, Minn.

[21] Appl. No.: 826,197

[22] Filed: Feb. 5, 1986

[51] Int. Cl.[4] ..... B65B 3/04; B05C 1/10

[52] U.S. Cl. ..... 401/144; 141/18; 141/20.5; 401/140; 401/176; 401/187; 401/197

[58] Field of Search ..... 401/187, 197, 144, 140, 401/188, 207, 189; 141/20.5, 350, 349, 348, 18

[56] References Cited

U.S. PATENT DOCUMENTS

| | | | |
|---|---|---|---|
| 1,714,350 | 5/1929 | De Jong | 401/207 X |
| 2,443,981 | 6/1948 | Funk et al. | 141/18 X |
| 3,476,507 | 11/1969 | Leeds | 141/348 X |
| 3,554,659 | 1/1971 | Stokes | 401/197 |
| 3,702,739 | 11/1972 | Rentfrow | 401/197 |
| 3,734,149 | 5/1973 | Hansel | 141/350 |
| 3,837,381 | 9/1974 | Arroyo | 141/350 |
| 4,231,668 | 11/1980 | Groth et al. | 401/197 X |

FOREIGN PATENT DOCUMENTS

| | | | |
|---|---|---|---|
| 784908 | 5/1968 | Canada | 401/188 |
| 212810 | 3/1941 | Switzerland | 141/20.5 |
| 255993 | 7/1948 | Switzerland | 141/20.5 |

*Primary Examiner*—Steven A. Bratlie

*Attorney, Agent, or Firm*—Peterson, Wicks, Nemer & Kamrath

[57] ABSTRACT

A fountain applicator handle is disclosed for providing a continuous supply of a liquid coating to an applicator head for application onto a surface. The fountain applicator handle includes an elongated hollow reservoir with sliding displacement piston disposed therein. A valve body is attached thereto and adapted for attachment to a coating supply, with the valve body allowing the communication of the coating into the reservoir while preventing the outflow of the coating to the applicator, and controllably communicating the coating from the reservoir to the applicator.

20 Claims, 6 Drawing Figures

15
46
25
47
28
48
3
14
25
11
27
13
10
12
30
33
34
3
39
41
40

23
30
32
31
18
17
16
12a
21
11
20
23

19
17
22
27
23a
23
25
24
26

FOUNTAIN APPLICATION HANDLE WITH REFILL VALVE

BACKGROUND OF THE INVENTION

1. Field of the Invention

Present invention pertains to a portable fountain applicator handle for providing a continuous flow of a liquid coating to an applicator head.

2. Description of the Prior Art

In order to enhance the beauty of and protect the surface of various items in his environment, man has applied various protective coatings thereto. Most commonly the coating applied is in the nature of a paint, however numerous other coatings such as shellac, varnish, white wash, or oil finishes are also used in certain instances. When the surface being coated is a flat surface, the coating is typically applied using a brush, a roller, or a powered spray gun.

When the coating is applied to a large uniform surface, it is necessary that an even layer of the coating be expeditiously applied covering the entire surface with a minimum amount of spillage or spatter to adjacent surfaces. Previously, the coating has been applied by dipping the brush, roller, or other applicator in a pool of the liquid coating and when the applicator obtained a proper quantity of the coating moving the applicator to the surface being coated and applying the coating to the surface. While this system does work, it has the dual disadvantages of providing a varying quantity of coating to the surface and dripping the coating onto other environmental surfaces creating an unsightly and difficult to clean mess.

The application of the varying amounts of coating to surfaces requires the operator to make multiple passes of the applicator over the surface being coated to produce a uniform film of the coating. When multiple passes are not made to level the coating film, unsightly drips, runs, or "lace-curtains" often result. In addition, the application of an uneven layer of coating causes, in some instances, uneven life of the coating manifested by premature chipping or peeling of the coating from the surface. Multiple passes over the coated surface require increased operator time spent on coating a given surface. The increase in time both decreases the operators productivity and increases the cost of coating the surface.

When the applicator is periodically refilled from the coating pool, it is advantageous that the operator maximizes the amount of coating being moved to the surface. In maximizing the quantity of coating being transferred, however, the operator increases the probability of drippage from the applicator into the environment when the applicator is moved from its filling area to the surface being coated. Such drippage and spillage is at the very least unsightly and is potentially damaging to the surface spilled upon. To prevent the spillage, it has been common practice to lay down drop clothes and the like to prevent such spillage. The additional step of laying down drop clothes caused further expenditures of time and money and decreases the efficiency of the entire process.

The art is replete with various solutions to the problems inherent in simple brushes and rollers. The continuous feed solutions tend to fall into two classes, external coating feeds and internal coating feeds External coating feed devices are typified by having an external coating container attached through the handle to the applicator using a flexible hose, with a pump urging the coating through the hose and handle thence into the applicator. Devices of this class, while resolving the difficulties of periodically refilling the coating applicator, tend to be rather large and require a certain amount of set up time and also a power source. Typically these devices draw the coating from a large reservoir and thus are more suited for applying the coating to large expanses of surfaces since the reservoir must be emptied and cleaned, or changed and the pump, the hose, the handle, and the applicator must be cleaned before another color or type of coating may be used in this system.

The second group of applicators are typified by having a coating reservoir integrated into the handle of the device and means providing a controlled flow of coating to the applicator. These applicators do not need to be repeatedly moved between a coating pool for refilling and the surface being coated thereby minimizing or eliminating the opportunity of coating drippage into the environment and. These applications provide an essentially continuous, uniform flow of the coating to the applicator head in turn providing a uniform layer of coating transferred to the surface with a minimum of applicator passes over the surface.

Prior art is replete with unitary devices wherein a reservoir handle is attached to an applicator. One such device is disclosed in U.S. Pat. No. 3,337,899 issued Aug. 29, 1967, to J. Rentfrow. The Rentfrow patent discloses the roller with attached reservoir handle. The reservoir handle feeds a continuous supply of paint to the roller assembly in response to spring pressure. The coating flow to the applicator may be controlled thereto by a valve disposed in the supply pipe. The Rentfrow paint dispenser, like all other unitary paint dispensers, must contain a reasonable small reservoir so the paint applicator may be conveniently moved along the surface being coated. The use of the small reservoir requires the periodic filling. In refilling, a fill pipe must first be attached, the fill valve opened, and the fill handle retracted against the pressure of the feed spring. This procedure tends to be rather inconvenient and clumsy.

Drawing the fill handle against the urgings of the feed spring, the operator must hold the entire assembly steady with the fill pipe submerged in the container. After retracting the fill handle, the operator must close the fill valve and remove the fill pipe before the paint dispenser can be reused.

U.S. Pat. 3,554,659 issued to R. E. Stokes on Jan. 12, 1971, attempts ro resolve the refilling problems by filling a removable paint container attached to the applicator handle. While this does make for a more convenient refilling of the paint applicator, it does limit the position in which the paint applicator may be used and prohibits inverting the applicator. Should the applicator be inverted, paint in the reservoir would obviously spill over the environment. Likewise, if the applicator were used to paint an overhead surface such as a ceiling, the supply container is now tipped on its side, a position where leakage is quite likely to occur.

U.S. Pat. No. 3,612,707 issued to Charles Herbrechter on Oct. 12, 1971, discloses another attempt at providing a self contained unitary applicator that can be conveniently refilled. The paint roller handle has a spring actuated deformable container defining its reservoir. The springs may be held compressed by detents. The roller is refilled by removing an end cap and pouring coating material into the expended reservoir.

While this resolves the inconvenience and clumsiness of retracting the spring loaded handle while maintaining a fill pipe in the paint container, it necessitates the use of a coating container from which the coating material may be conveniently poured from and further requires the roller be held in an upright and vertical position for refilling. Where the coating purchased in large volume containers, such as five gallon pails, this arrangement would necessitate the transfer of the coating to an intermediate container for transfer into the paint roller handle.

The known prior art has not been able to effectively overcome the construction, refilling, and convenience problems in this area.

OBJECTS OF THE INVENTION

The object of the invention is to provide a unitary paint applicator handle and reservoir with an improved self actuated filler valve.

It is another object of the invention to provide a fountain applicator operable in any position.

The further object of the invention is to provide a fountain applicator adaptable to be easily refilled from any size of coating container.

These and other objects of the invention will become manifest in the art upon review and usage of the teachings herein.

SUMMARY OF THE INVENTION

According to the principles of the present invention, the fountain applicator comprises a clear tubular handle with a valve body at one end. A displacement piston slides within the reservoir fountain handle of the applicator. The valve body has a central channel passing longitudinally thereto communicating the paint from the reservoir contained in the handle into the applicator.

The radial channel extends diagonally from the periphery of the valve body intersecting the central channel. The fill channel has a one way check valve disposed in it at the periphery of the valve body. A tapered seat is disposed coaxially to the radial channel intersecting the central channel having dimensions to accept a fill tube.

When filling the reservoir the fill tube is inserted into the fill channel through the check valve and seals into the tapered seat. When the displacement piston is moved away from the valve body, the coating is directed into the reservoir by the fill tube while preventing flow to the applicator head due to its sealing in the tapered seat. With the reservoir filled, the fountain applicator is removed from the fill tube thereby allowing the check valve to reseal and preventing the flow of coating out from the fountain applicator.

These and other aspects and manifestations of the invention will become manifest to those versed in the art upon reference to and reviewal of the teachings herein.

DESCRIPTION OF THE PREFERRED EMBODIMENT

Figure 1:
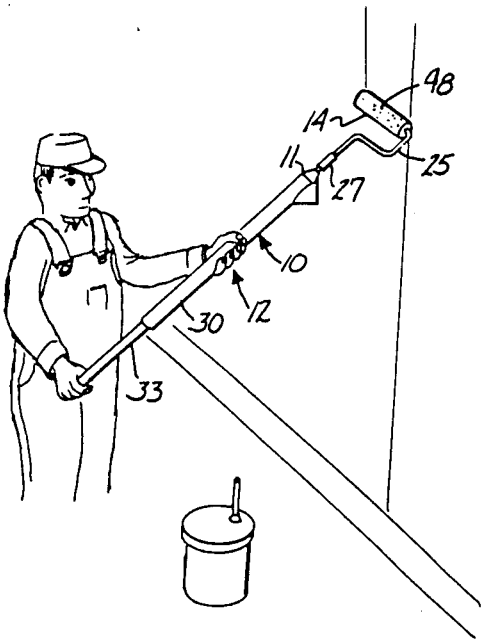
FIG. 1. is an overall illustration showing an operator using the fountain applicator handle to apply paint to a wall.
Figure 3:
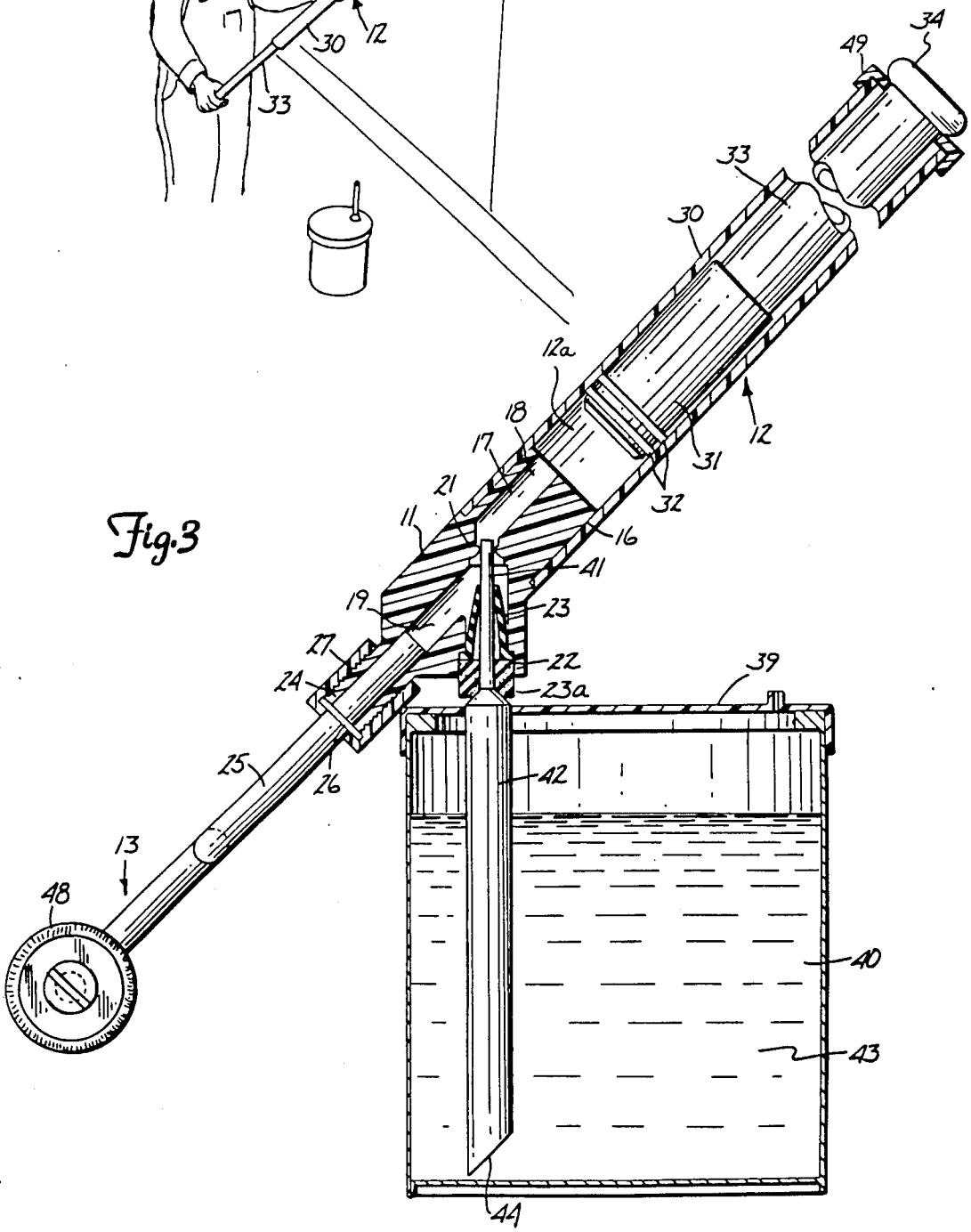
FIG. 3. is a longitudinal cross sectional view of the fountain applicator handle taken approximately along 3—3 of FIG. 2 showing the fill pipe inserted for filling of the applicator.
Figures 2, 4, 5, 6:
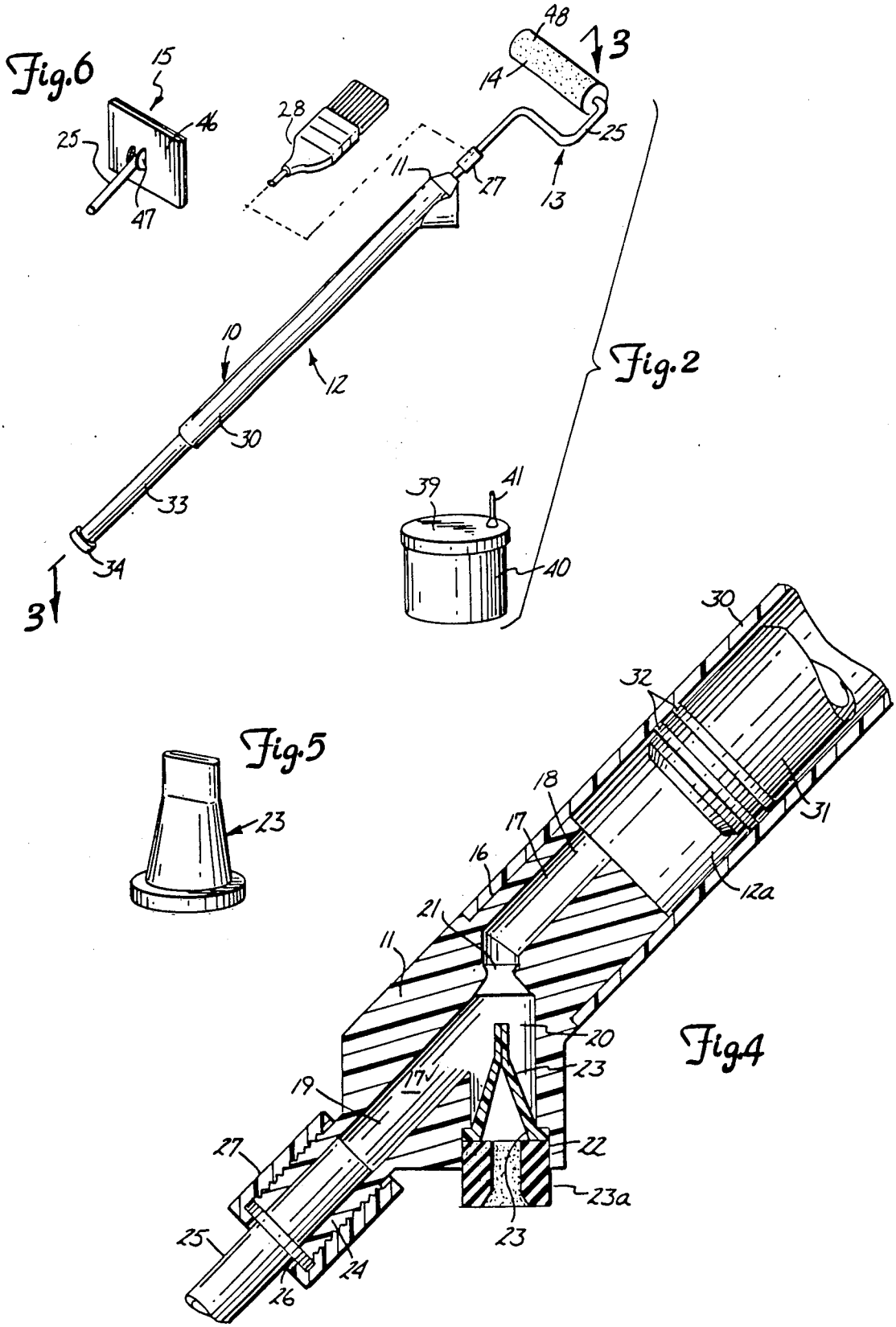
FIG. 2. is an overall perspective view of the fountain applicator handle showing a paint roller attached as the applicator head and a brush applicator.
FIG. 4. is a longitudinal cross sectional view of the fountain applicator handle similar to FIG. 3 with the fill pipe removed.
FIG. 5. is a perspective view of the duck-bill style check valve.
FIG. 6. is an overall perspective view of an attachable pivoting paint pad applicator.

Fountain applicator handle 10 is composed of valve body 11, reservoir tube 12, and applicator head 13. The applicator head may be either a roller type head 14, a fountain type paint pad 15, or a brush applicator 28.

The valve body 11 is formed from a single piece of polymeric material and has a reduced diameter portion 16 adjacent the reservoir tube 12. A longitudinal central channel 17 extends through the valve body 11. The central channel 17 has an inlet channel 18 adjacent the reservoir tube 12 and an outlet channel 19 adjacent the applicator head 13. A radial channel 20 extends from the outer periphery of the valve body 11 across the central channel 17 at the intersection of the inlet channel 18 and outlet channel 19.

A tapered seal 21 is disposed at the intersection of the radial channel 20 and the inlet channel 18 of the valve body 11. The seal 21 may be a separate element such as an "O"-ring and preferably is a tapered seat formed in the valve body 11. An enlarged diameter recess 22 is formed in the radial channel 20 adjacent to the periphery of valve body 11. A check valve, preferably, a one way duck bill style check valve 23 is disposed within the radial channel 20 and positioned allowing the entry of fluids and preventing the exit of fluids.

A drip sponge **23*a* may be attached at the outer end of the radial channel 20 of the valve body 11. The drip sponge 23*a* has a central opening allowing insertion of the fill tube 41**.

The applicator head 13 may be attached by any suitable means, and is preferably attached by forming a threaded nipple 24 extending outwardly from the valve body 11 suitable for receiving the feed tube 25 of applicator head 13. A retainer ring 26 is located on the feed tube 25 for retaining the applicator head 13 in a fixed relationship to the valve body 11. A retainer nut 27 fits over the retainer ring 26 engaging the threaded nipple 24 retaining the applicator head 13 to the valve body 11.

The reservoir tube 12 has a preferably clear outer tube 30 attached about the reduced diameter portion 16 of the valve body 11. The piston 31 is slidingly disposed within the clear outer tube 30. The piston 31 is sealed against the inner wall of the outer tube 30, preferably using an "O"-ring 32. A piston rod 33 is affixed to the piston 31 and extends outwardly away from the valve body 11 past the distal end of the outer tube 30. A piston handle 34, such as in large knob, may be attached to the piston rod 33 to facilitate operation. A retaining collar 49 is affixed to reservoir tube 12 by a press fit. The retaining collar 49 prevents the piston 31 from inadvertent removal from reservoir tube 12 when the piston rod 33 is fully extended.

The filler lid 39 is made of a plastic material of a size suitable for snap fitting over a paint container 40. The filler lid 39 has a fill tube 41 extending orthogonally upward from its surface. The fill tube 41 extends through the filler lid 39 and has a suction end tube 42 attached thereto.

The suction end tube 42 may be attached by any suitable means such as adhesive, friction, or molded in one piece to the fill tube 41. The suction end tube 42 is of the length so as to reach the bottom of container 40 thereby allowing substantially all of the paint 43 contained therein to be removed. The suction end tube 42 further terminates in a diagonal end section 44 or similar shape to prevent tube 42 from sucking the bottom of container 40.

The fill tube 41 is attached to the filler lid 39 by any of a number of suitable means such as heat, fusion, adhesive, or friction. The fill tube 41 has a diameter to allow easy insertion through the duck bill style check valve 23 and further to seal on the tapered seal 21 of the valve body 11.

When a paint pad 15 is used to apply the coating to the surface, especially adapted paint pad 15 is used. The paint pad 15 has a feed tube 25 adapted for connection to the threaded nipple 24 of the valve body 11 and an applicator pad 46 pivotally attached thereto. The pad pivot 47 is designed allowing the applicator pad 46 to pivot in a small arc in relation to the feed tube 25 and ratchets through a larger arcuate range.

In its use, the fountain applicator handle 10 is prepared by attaching a suitable applicator head 13 such as a roller type head 14 or fountain type paint pad 15. The roller type head 14 used may be of any conventional design, such as a Power-Flo Roller from Power-Flo Products Corporation, Minneapolis, Minn. Such a roller type head 14 is constructed to accept any one of a number of commercially available roller sleeves 48.

The fountain applicator handle 10 may then be filled with the paint 43 by first inserting the fill tube through the 41 duck bill style check valve 23 of the radial channel 20 thereby sealing the fill tube 41 into the tapered seal 21. The operator, thence, using the piston handle 34 attached to the piston rod 33 causes the piston 31 to move away from the valve body 11 thereby urging the flow of paint 43 upwardly from the paint container 40 through the suction end tube 42 and the fill tube 41 into the inlet portion 18 at the valve body 11 in the reservoir space 12*a*. When the reservoir space 12*a* is full, the piston 31 will abut against the retaining collar 49 preventing the piston 31 from being pulled out of the reservoir tube 12 and spilling the paint 43.

With the reservoir space 12*a* sufficiently filled with the paint 43, the fountain applicator handle 10 is removed from the fill tube 41 and is ready to apply the paint through the applicator head 13 to the surface being coated. The operator then compresses the reservoir space 12*a* in response to urgings applied to piston handle 34 thereby forcing the paint 43 through the central channel 17 of the valve body 11 and further communicating the paint through the feed tube 25 thence to the applicator head 14. Paint 43 is distributed in the applicator head 14 to the interior thereof and thence to the interior of the roller sleeve 48 and thence transferred to the surface being coated as shown in FIG. 1. The operator may vary the quantity of paint 43 being fed to the applicator head 14 by his actions on the piston handle 34, thus, allowing the operator to provide an effectively continuous flow of paint 43 for coating in an even film of the coating upon the surface.

The operation of the fountain applicator handle 10 is similar when a fountain paint type pad 15 is used to apply the coating. However, as the operator moves the fountain applicator handle 10 angularly through an arc while spreading the coating upon the surface being coated, the pad pivot 47 operates varying the angle between the feed tube 25 and the applicator pad 46, thereby maintaining the pad contact with the surface being painted.

When the reservoir space 12*a* has been depleted of its supply of paint 43, the reservoir space 12*a* may be refilled by again inserting the fill tube 41 through the duck bill style check valve 23 and the drip sponge 23*a* into the tapered seal 21 and withdrawing the piston 31 causing the flow of the paint 43 into the reservoir space 12*a*. Upon removal of the fill tube 41, the drip sponge 23*a* wipes the excess paint 43 from the fill tube 41 preventing loss of paint 43 to the environment.

After the painting has been completed, the fountain applicator handle 10 may be readily cleaned and purged of the paint by removing the filler lid 39 from the paint container 40 and replacing the filler lid 39 on a container of cleaner, such as water for a water-based paint. Fountain handle applicator 10 may be then placed over the fill tube 41 and the piston handle 34 withdrawn to draw the cleaning solution into the reservoir tube 12. Piston handle 34 is then depressed, forcing the cleaning solution back into its container. This action may be repeated until reservoir tube 12 has been cleaned of the paint. Additionally, the reservoir tube 12 may be cleaned on the cleaning solution, and the fill tube 41 removed from the valve body 11 so as the cleaning solution may be forced outwardly through the applicator head 13 to purge the coating from the intermediate connectors and the applicator head 13. Its cleaning may conveniently be done when using a water-based coating, by filling the reservoir tube 12 with water and then forcing the water through the applicator head 13 while the applicator head 13 is held under a stream of flowing water, and collecting such cleaning solution for disposal.

The fountain applicator handle 10 may thus be used to apply coatings to any surface whether the surface is vertical, overhead or underfoot.

With proper choice of applicator heads 13, the fountain applicator handle 10 may be used for a multitude of tasks, such as the handle may be used to apply a spray of liquid such as water or a chemical solution to a distant surface when an applicator head 13 of a spray nozzle type is attached. By removing the applicator head 13, the fountain applicator handle 10 may be used as a serviceable displacement type pump by inserting the threaded nipple end 24 into the liquid being moved and withdrawing the piston handle 34 to fill the reservoir tube 12 with the liquid and, thence, moving the fountain applicator handle 10 to the area of discharge and depressing the piston handle 34 thereby purging the liquid from the reservoir tube 12 into another area.

These advantages, usages, and many other usages will be found in real life by those versed in the art, and although various minor modifications may be suggested and employed by those versed in the art, be it known that we wish to embody within the scope of the patent granted hereon all such embodiments reasonably come within the scope of our contributions to the art.

What is claimed is:

1. Fountain applicator for providing a continuous supply of a liquid coating including a reservoir for storing the liquid coating, a central channel having an inlet in communication with the reservoir and having an outlet, a fill channel extending angularly across and intersecting with the central channel between the inlet and outlet, and a fill tube in fluid communication with a source of liquid coating, with the improved fountain applicator comprising, in combination: first sealing means located in the fill channel spaced from the central channel for preventing flow of the liquid coating from the fill channel and for allowing insertion of the fill tube into the fill channel; and second sealing means located adjacent the intersection of the fill channel with the central channel for sealing with the fill tube when inserted in the fill channel for allowing the liquid coating to pass from the fill tube through the inlet of the central channel into the reservoir and preventing liquid coating flow from the fill tube through the outlet of the central channel and for allowing liquid coating flow in the central channel through the outlet when the fill tube is removed from the fill channel.

2. The fountain applicator of claim 1 wherein the first sealing means comprises a displaceable septum valve.

3. The fountain applicator of claim 2 wherein the septum valve is a one-way check valve disposed to allow ingress and prevent egress of the liquid coating in the radial channel.

4. The fountain applicator of claim 3 wherein the check valve is a duck bill style check valve.

5. The fountain applicator of claim 1 wherein the central channel comprises, in combination: an inlet channel adjacent the inlet; and an outlet channel adjacent the outlet, with the outlet channel being offset but parallel to the inlet channel, with the fill channel intersectingly connecting the inlet channel and the outlet channel, with the second sealing means located between the inlet channel and the outlet channel.

6. The fountain applicator of claim 1 wherein the second sealing means comprises a tapered segment in the fill channel.

7. A fountain applicator handle for providing a continuous supply of a liquid coating to an applicator head for coating the liquid coating onto a surface comprising:

(a) an elongated hollow reservoir having a first end and a second end;

(b) a sliding displacement means disposed within said reservoir;

(c) a valve body attached at the first end of said reservoir forming an end cap thereto, with the valve body having a longitudinal central channel extending centrally therethrough and having a radial channel extending angularly across the central channel; a displaceable septum valve disposed in the radial channel spaced from the central channel; and sealing means disposed in the radial channel across the central channel;

(d) an insertable fill tube having external dimensions to cooperatively insert through the radial channel and the septum valve and sealingly fit into the sealing means, whereby when inserted, the fill tube will pass the coating into the reservoir in response to the sliding of the displacement means while preventing flow of the coating to the applicator head and when the fill tube is removed from the septum valve, flow of coating out the septum valve is prevented and the flow of coating to the applicator head through the central channel is allowed.

8. The fountain applicator handle of claim 7 wherein the hollow reservoir is cylindrical.

9. The fountain applicator handle of claim 8 wherein the displacement means comprises a piston slidingly disposed within the hollow reservoir.

10. The fountain applicator handle of claim 9 wherein the piston further comprises at lease one seal ring removably retained about the piston sealingly cooperating with the reservoir.

11. The fountain applicator handle of claim 1 wherein the central channel comprises, in combination: an inlet channel adjacent the reservoir; and an outlet channel distal the reservoir, with the inlet channel being parallel but offset from the outlet channel, with the radial channel intersectingly connecting the inlet channel and the outlet channel at the sealing means.

12. The fountain applicator handle of claim 7 wherein the sealing means comprises a tapered seat in the radial channel.

13. The fountain applicator handle of claim 7 wherein the septum valve is a one-way check valve disposed to allow ingress and prevent egress of the liquid coating in the radial channel.

14. The fountain applicator handle of claim 13 wherein the check valve is a duck bill style check valve.

15. The fountain applicator handle of claim 7 further comprising a suction tube extending oppositely from the fill tube.

16. The fountain applicator handle of claim 15 further comprising a filler lid, with the fill tube affixed to and extending orthogonally through the filler lid.

17. The fountain applicator handle of claim 16 further comprising means for removably retaining the filler lid to a coating container.

18. The fountain applicator handle of claim 17 wherein the filler lid is disposed at the juncture of the fill tube and the suction tube.

19. The fountain applicator handle of claim 7 wherein the applicator head comprises:

(a) a pad holder having a porous pad affixed to a first side and an opposite, second side;

(b) a rigid tubular connector in fluid communication with the central channel and the pourous pad; and (c) means for connecting the tubular connector to the second side of the pad holder allowing the pad holder to pivot in a small arc in relation to the tubular connector and to ratchet through a larger arcuate range.

20. Fountain applicator handle for providing a continuous supply of liquid coating to an applicator head for coating the liquid coating onto a surface comprising:

(a) an elongated tubular reservoir; a displacement piston slidingly disposed in the reservoir, with the piston further having at least one seal ring in sealing cooperation with the reservoir;

(b) a valve body having a first end attached to the tubular reservoir and a second end adapted for attachment to the applicator head, with the valve body having an inlet channel extending inwardly from the first end thereof, with the valve body having an outlet channel centrally located and extending inwardly from the second end, with the valve body having a radial channel extending inwardly between the first and second ends of the valve body and intersecting and joining the inlet channel and the outlet channel at a juncture; a tapered segment coaxially disposed at the juncture of the radial channel and the inlet channel; a one way duck bill check valve disposed in the radial channel spaced from the inlet channel and the outlet channel;

(c) a fill tube; an oppositely extending suction tube attached to the fill tube at a juncture; a filler lid orthogonally attached at the juncture of the fill tube and the suction tube; with the filler lid adapted to be removably retained upon an open, coating container; whereby with the fill tube inserted in the radial channel through the duck bill check valve, the fill tube cooperatively seals with the tapered segment allowing the liquid coating to be communicated between the coating container and the reservoir in response to the urgings of the piston while preventing flow of the coating to the outlet channel; and with the fill pipe removed, the liquid coating is communicated from the reservoir to the applicator head through the inlet and outlet channels and the liquid coating is prevented from flowing out of the radial channel by the duck bill check valve.

* * * * *

UNITED STATES PATENT OFFICE

CERTIFICATE OF CORRECTION

Patent No. 4,695,176 Dated September 22, 1987

Inventor(s) Dallas W. Simonette and Bruce A. Wiener

It is certified that error appears in the above-identified patent and that said Letters Patent are hereby corrected as shown below:

Column 1, line 27, after "coating" insert --,--.

Column 1, line 66, after "feeds" insert --.--. (2nd occurr.)

Column 3, line 47, after "reservoir" insert --,--.

Column 4, line 8, cancel "duck-bill" and substitute therefor --duck bill--.

Column 5, line 36, after "tube" insert --41--.

Column 5, line 37, cancel "41".

Column 6, line 29, cancel "on" and substitute therefor --of--.

UNITED STATES PATENT AND TRADEMARK OFFICE

CERTIFICATE OF CORRECTION

PATENT NO. : 4,695,176

DATED : September 22, 1987

INVENTOR(S) : Dallas W. Simonette and Bruce A. Wiener

It is certified that error appears in the above-identified patent and that said Letters Patent is hereby corrected as shown below:

Column 8, line 8, claim 11, line 1, cancel "1" and substitute therefor --7--.

Signed and Sealed this

Twenty-sixth Day of January, 1988

*Attest:*

DONALD J. QUIGG

*Attesting Officer*

*Commissioner of Patents and Trademarks*